United States Patent [19]

Edmondson et al.

[11] Patent Number: 4,867,492

[45] **Date of Patent: * Sep. 19, 1989**

[54] DOOR LATCH ASSEMBLY

[75] Inventors: Peter C. Edmondson, 16 Stadler, Woodside, Calif. 94062; John T. Kairis, Sausalito, Calif.

[73] Assignee: Peter C. Edmondson, Woodside, Calif.

[ * ] Notice: The portion of the term of this patent subsequent to Aug. 8, 2006 has been disclaimed.

[21] Appl. No.: 99,282

[22] Filed: Sep. 21, 1987

[51] Int. Cl.[4] ..... E05C 1/12

[52] U.S. Cl. ..... 292/165; 292/167; 292/193; 292/336.3; 292/347

[58] Field of Search ..... 292/165, 167, 139, 140, 292/347, 336.3, 0.53, 0.54, 0.65, 0.71, 193, 239; 362/100

[56] References Cited

U.S. PATENT DOCUMENTS

| | | | |
|---|---|---|---|
| 1,263,880 | 4/1918 | Hossop | 292/347 |
| 2,160,762 | 5/1939 | Stenberg | 292/337 |
| 2,308,844 | 1/1943 | Wilshusen | 292/347 |
| 2,494,478 | 1/1950 | Kuzma | 292/165 |
| 3,829,137 | 8/1974 | MacDonald | 292/171 |
| 3,955,075 | 5/1976 | Susedik | 362/100 |
| 3,999,411 | 12/1976 | Kambic | 292/165 X |
| 4,234,909 | 11/1980 | Cotroneo | 362/100 |
| 4,268,075 | 5/1981 | Allenbaugh | 292/167 |
| 4,573,723 | 3/1986 | Morita et al. | 292/336.3 |
| 4,596,411 | 6/1986 | Geringer et al. | 292/165 |
| 4,627,649 | 12/1986 | Leplat | 292/0.65 X |

FOREIGN PATENT DOCUMENTS

| | | | |
|---|---|---|---|
| 67789 | 7/1929 | Sweden | 292/167 |
| 19613 | of 1903 | United Kingdom | 292/165 |
| 626254 | 7/1949 | United Kingdom | 292/165 |

*Primary Examiner*—Lloyd A. Gall
*Assistant Examiner*—Curtis B. Brueske
*Attorney, Agent, or Firm*—Townsend and Townsend

[57] ABSTRACT

The present invention is directed to an improved door latch assembly having a rotatable member which is transparent or translucent and to which a door knob structure is coupled. The member is rotatably mounted between a pair of support plates, and the member has a roller on the outer periphery thereof. A number of pivotally mounted links on one of the support plates operates to move a latch bolt into its retracted position when the roller moves in either direction under the influence of the rotation of the member by turning a door knob element of the door structure. The various links cooperate with each other to cause immediate movement of the latch bolt upon rotation of the member, yet the links are not visible from a position exteriorly of the door in which the latch assembly is mounted. Thus, one viewing the door and the panel member cannot discern how the door latch operates because the links are effectively concealed in the door and the only viewable parts of the assembly are the member, the plates and the door knob structure coupled to the member. An apparatus for cutting a mortise in a door is also disclosed.

12 Claims, 3 Drawing Sheets

DOOR LATCH ASSEMBLY

This invention relates to improvements in latches for swinging doors and, more particularly, to a door latch assembly having aesthetic features which are also functional in the use of the assembly.

BACKGROUND OF THE INVENTION

In U.S. patent Ser. No. 098,577, filed Sept. 18, 1987, there is disclosed a decorative door latch assembly having a plate-like member for rotatably mounting a door knob structure. The member is of a material capable of allowing light to pass therethrough. To this end, the member can be transparent or translucent and is mounted in a door in a manner such that the way in which the door knob structure is coupled to a latch bolt forming part of the latch assembly is not discernible by merely viewing the member or the door knob structure. The member when rotated, causes a mechanism alternately to retract and extend a latch bolt relative to a latch plate. It is not apparent to the average person that there is a rotation of the member relative to the door when the door knob structure is rotated. Thus, the way in which the door latch assembly operates to unlatch or unseat the latch bolt is seemingly magical in effect because rotation of the member cannot be observed if the member is sufficiently clean and otherwise free of visible marks which would indicate rotation of the member as the door knob structure is rotated. Thus, the door latch assembly of the foregoing disclosure provided not only an aesthetic effect but also a functional effect as well, yet the assembly is simple in construction and made of a relatively few number of parts.

It has been found that the structure of the door latch assembly described above can be further simplified by improved linkage means which is rugged in construction and allows for a quick and easy installation of the latch assembly in a mortise of a door. The present invention provides such improvements.

SUMMARY OF THE INVENTION

The present invention is directed to an improved door latch assembly having a rotatable member which is transparent or translucent and to which a door knob structure is coupled. The member is rotatably mounted between a pair of support plates, and the member has a roller on the outer periphery thereof. A number of pivotally mounted links on one of the support plates operates to move a latch bolt into its retracted position when the roller moves in either direction under the influence of the rotation of the member by turning a door knob element of the door knob structure. The various links cooperate with each other in a manner to cause immediate movement of the latch bolt upon rotation of the member, yet the links are not visible from a position exteriorly of the door in which the latch assembly is mounted. Thus, one viewing the door and the panel member cannot discern how the door latch operates because the links are effectively concealed in the door and the only viewable part of the assembly are the member and the door knob structure coupled to the member.

The primary object of the present invention is to provide an improved door latch assembly of the type described wherein the latch assembly includes improved linkage means coupled with a member which is either transparent or translucent to simplify the way in which the member is rotated while providing an aesthetic effect to enhance the decor of the room having the door on which the door latch assembly is mounted.

Other objects of this invention will become apparent as the following specification progresses, reference being had to the accompanying drawings for an illustration of the invention.

In the drawings

DETAILED DESCRIPTION

Figure 6:
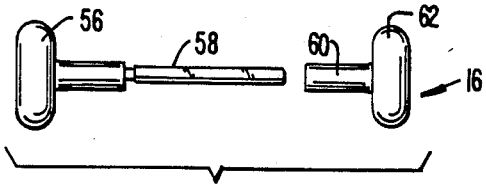
FIG. 6 is a side elevational view of the door invention.

The door latch assembly of the present invention is broadly denoted by the numeral 10 and is adapted to be used with a conventional swinging door 12 having hinges 14 which permit the door to swing open about a vertical axis through the hinge line of the hinges 14. Assembly 10 includes a door knob structure 16 (FIG. 6) carried by a transparent or translucent member 18 which is viewable through a pair of aligned holes 20 in the door 12, the latter having a mortise 23 which receives assembly 10 and allows a person to see through the member 18 and to realize that there is no seemingly apparent structure coupling door knob structure 16 with the door itself. Thus, the way in which the rotation of the door knob structure 16 causes the latch bolt 22 of assembly 10 to unlatch or to be retracted from an extended position is not readily discernible. Hence, the transparent or translucent characteristic of member 18 serves to baffle users of the door so that the member 18 provides an aesthetic effect as well as a puzzling, functional effect as hereinafter described.

Figure 5:
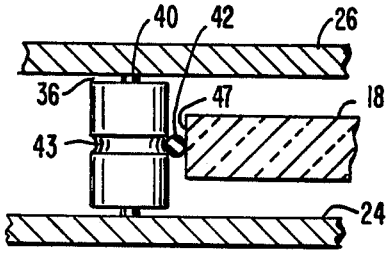
FIG. 5 is an enlarged, fragmentary, cross sectional view taken along line 5—5 of FIG. 3.
Figure 4:
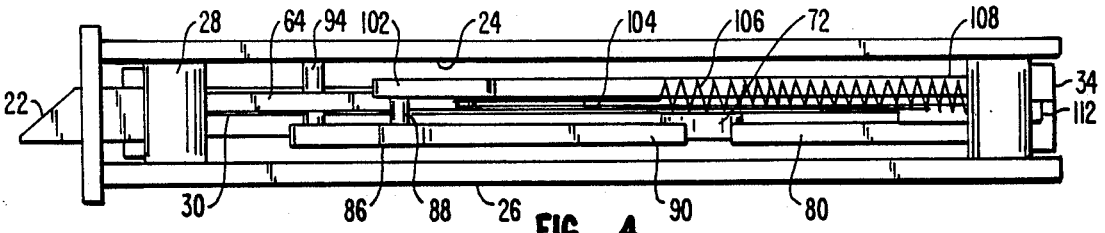
FIG. 4 is an end elevational view of the assembly of FIG. 3.
Figure 3:
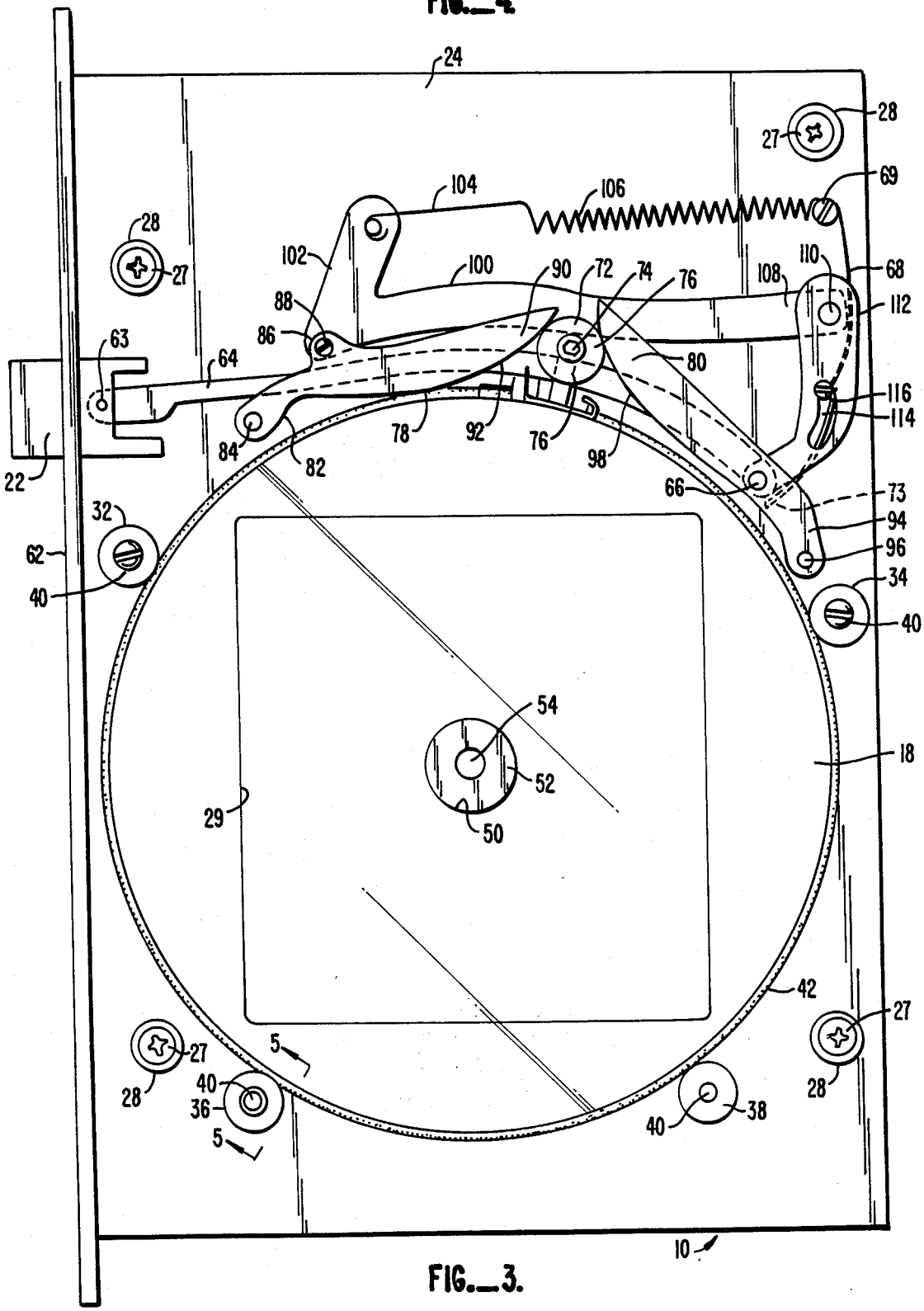
FIG. 3 is a side elevational view of the assembly of the present invention, showing the way in which the assembly is constructed to move a latch bolt from an extended position to a retracted position to permit opening of the door.

Assembly 10 as shown in FIGS. 3–5 includes a pair of spaced, generally flat support plates 24 and 26 (FIG. 4), the plates being generally rectangular in configuration. The plates are coupled together by any suitable means, such as by threaded machine screws 27 passing through sleeves 28 (FIG. 3) such that the plates 24 and 26 are spaced apart to present an internal space 30 therebetween.

Plate 24 is the support for transparent or translucent, cylindrical member 18 by virtue of a number of spaced bearings 32, 34, 36, and 38 which are secured in any suitable manner for rotation on plate 24 by respective pins 40. The bearings are located sufficiently close to the outer periphery of the member 18 so that the member is effectively supported and is retained yet the member is rotatable about its central axis.

Preferably, a transversely circular band 42 (FIG. 5) surrounds the outer periphery 47 of member 18. This band is complementally received in a groove 43 in the outer periphery of each of the bearings 32, 34, 36 and 38, respectively, as shown in FIG. 5. Thus, member 18 remains centered on the bearings, yet the member can easily rotate about its central axis.

The member 18 has a central hole 50 therethrough for receiving, in press-fitted fashion, a sleeve 52 having a central bore 54. Knob structure 16 (FIG. 6) includes a first knob element 56 having a shaft 58 for coupled relationship with the tubular stem 60 of a second knob member 62. Knob structure 16 is coupled to member 18 by inserting shaft 58 in hole 54 and then securing stem 60 to shaft 58 on the opposite side of the member 18. The shaft 58 has flats on it for mating with one or more flat surfaces internally of sleeve 52. This allows the knob structure to be rigidly connected to member 18 and allows the knob structure to be rotated in opposite directions so that member 18 can be moved about its central axis relative to the bearings 32, 34, 36 and 38 in either direction.

Plates 24 and 26 have generally rectangular holes 29 therethrough as shown in FIG. 3. These holes 29 are slightly larger than holes 20 in door 12 so that, once the assembly 10 is mounted in the door 12, plates 24 and 26 are not generally visible in holes 20 of door 12.

Latch bolt 22 (FIGS. 1 and 3) is shiftably carried by a latch plate 62 coupled with plates 24 and 26 as shown in FIG. 4. The latch bolt 22 is coupled by a pin 63 to one end of a link 64 having a hooked opposite end surrounding and movable relative to a pin 66 carried by plate 24. A leaf spring 68 is anchored at one end thereof by a pin 69 on plate 24, the opposite site end 73 of spring 68 bearing against the hooked opposite end of link 64 to bias the link to the left when viewing FIG. 3. Thus, latch bolt 22 will be biased toward its extended or outwardly projecting position shown in FIGS. 3 and 4.

A roller 72 is secured by a pin 74 to a radial tab 76 rigid to and extending outwardly from the outer periphery of member 18 as shown in FIG. 3. Roller 72 is rotatable about an axis parallel with the central axis of member 18. Roller 72 is engaged at the opposite sides thereof by a pair of links 78 and 80. Links 78 and 80 are generally coplanar with each other and are out of the plane of link 64.

Link 78 has a first end 82 (FIG. 3) pivotally coupled on a pin 84 carried by plate 24. An intermediate ear 86 on link 78 is rotatably mounted on a pin 88 carried by an L-shaped link 100. The opposite end 90 of link 78 has an end surface 92 normally engaging the outer periphery of roller 72 as shown in FIG. 3.

Link 80 has one end 94 (FIG. 3) pivotally mounted on a pin 96 carried by plate 24. Link 80 is pivotally mounted intermediate its ends on pin 66, and link 80 has an end surface 98 for normally engaging the outer periphery of roller 72 as shown in FIG. 3.

L-shaped link 100 is generally coplanar with link 64 and is pivotally carried by pin 88 (FIG. 3) for rotation with link 78 about pin 84 as the link 78 is moved to the left when viewing FIG. 3 under the influence of roller 72. A projecting finger 102 on link 100 has an outer end to which one end 104 of a spring 106 is secured. The opposite end of the spring is coupled to pin 69.

The opposite end 108 of link 100 is pivotally coupled by a pin 110 to one end of a link 112 whose opposite end carries pin 66. Link 112 has a curved, longitudinal slot 114 therein for receiving a pin 116 rigid to and projecting outwardly from plate 24. Link 112 serves to allow movement of link 64 to the right when viewing FIG. 3 in response the rotation of member 18 in either direction. Link 112 also serves to increase the bias force of spring 106 when link 64 moves to the right when viewing FIG. 3.

In operation, plates 24 and 26 are coupled together with the link mechanism of FIG. 3 between the plates as shown so that rotation of member 18 in either direction by turning one of the door knob elements 56 and 62 (FIG. 6) will cause movement of latch bolt 22 into its retracted position. Release of the turning force on the door knob element will cause the member 18 to return to its initial or equilibrium position shown in FIG. 3, forcing latch bolt 22 back into its extended position as shown in FIGS. 3 and 4.

Figure 1:
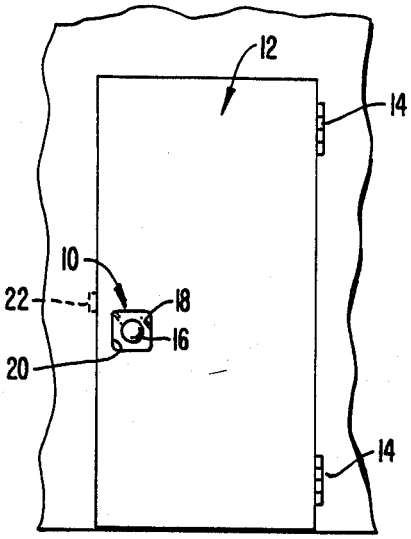
FIG. 1 is a side elevational view of a door having improved door latch assembly of the present invention thereon.
Figure 2:
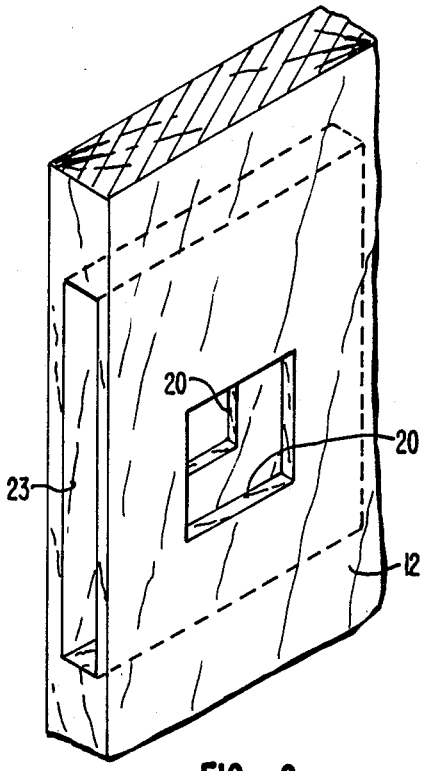
FIG. 2 is an enlarged, fragmentary, perspective view of a door having a mortise for receiving the assembly of the present invention.

To mount assembly 10 on door 12, assembly 10 is first inserted into mortise 23 of door 12, and latch plate 62 is anchored to the door, such as by screws, at the ends of the plate 62. Then, door knob structure 16 is coupled with sleeve 52 so that the door knob elements 56 and 62 are accessible from respective sides of the door as shown in FIG. 1.

When it is desired to open the door, one of the knob elements 56 and 62 is rotated in either direction to rotate member 18. If rotation is counter clockwise when viewing FIG. 3, roller 72 is caused to rotate with member 18, forcing link 78 to rotate about pin 84 in a counter clockwise sense. This movement of link 78 causes movement of pin 88 to the left when viewing FIG. 3, increasing the bias force of spring 106. The purpose of link 100 and spring 106 is to provide a bias force tending to return link 78 and thereby roller 72 to their initial or equilibrium positions as shown in FIG. 3. Thus, when the door knob force is released, the member 18 automatically rotates back into its equilibrium position shown in FIG. 3 under the influence of spring 106.

As link 100 moves to the left when viewing FIG. 3, it causes link 112 to pivot about pin 116 in slot 114, causing pin 66 to move the hooked shaped end of link 64 to the right when viewing FIG. 3, thereby causing latch bolt 22 to be pulled to the right and into a retracted or unlatched position. Also, during this pivotal movement of link 112, link 80 is pivoted in a clockwise sense about pin 96 and moves with pin 66 to the right relative to plate 24. Release of the turning force on the door knob element 56 or 62 allows link 112 to return to the equilibrium position hereof shown in FIG. 3.

Rotation of member 18 a clockwise sense (viewing FIG. 3) by turning a knob element 56 or 62 causes roller 72 to force link 80 to rotate in a clockwise sense about pin 96 and at the same time, causing movement of pin 66 to the right, carrying the end of link 64 with it. Movement of link 64 to the right causes latch bolt 22 to move into its retracted or unlatched position to allow opening of the door.

Movement of link 80 to the right also causes pivotal movement of the upper end of link 112 to the left, forcing link 100 to the left and increasing the bias force on spring 106. Release of the turning force of the door knob element allows spring 106 to return link 100 and link 112 to their equilibrium positions, whereupon link 80 will assume the position in FIG. 3.

Thus, it can be seen that regardless of the direction of rotation of member 18 under the force applied to either door knob element 56 or 62, the latch bolt 22 will be shifted so that it moves into its retracted position, thereby clearing the adjacent striker plate and allowing the door to be opened.

Figure 7:
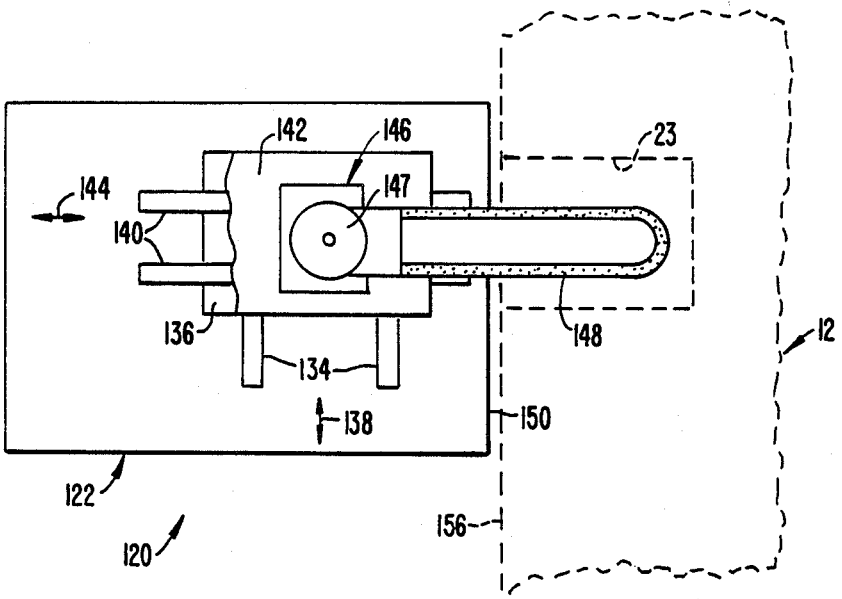
FIG. 7 is a top plan view of an apparatus for cutting a mortise in a door to accommodate the assembly of the present invention.
Figure 8:
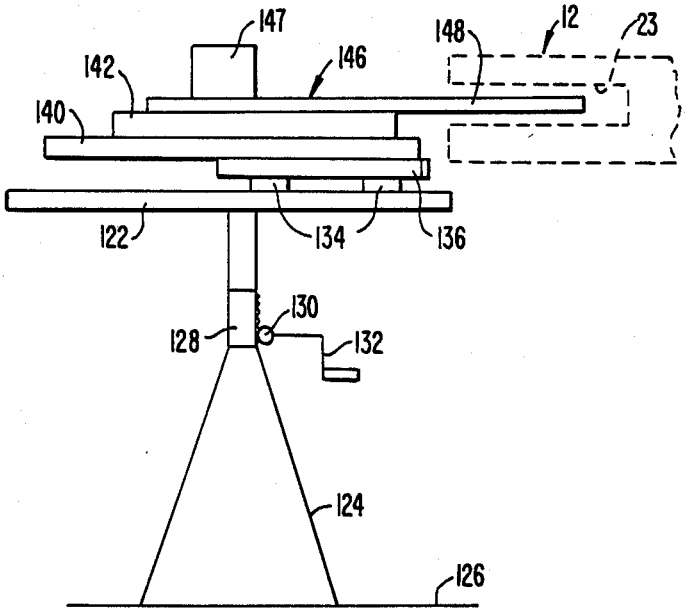
FIG. 8 is a side elevational view of the apparatus of FIG. 7.

FIGS. 7 and 8 show top plan and side elevational views of an apparatus for cutting mortise 23 of door 12. The apparatus shown in FIGS. 7 and 8 is broadly denoted by the numeral 120 and includes a table 122 having a base 124 for resting on a floor or other surface 126. The base 124 is coupled to a rack 128 which extends between the table 122 and the upper end of the base 124. A pinion 130 coupled with rack 128 is rotated by a handle 132 to raise and lower table 122 with respect to a surface 126.

Table 122 has a pair of spaced, parallel tracks 134 thereon on which a plate 136 is movable. The plate 136 is coupled by bearings (not shown) to tracks 134 so that plate 136 can move in the direction of arrows 138 (FIG. 7) in opposed directions.

Plate 136 has a pair of spaced, parallel tracks 140 mounted thereon in any suitable manner. Tracks 140 are adapted to shiftably mount a second plate 142 above the first plate 136 for movement relative to the first plate in the direction of arrows 144 (FIG. 7). Because of tracks 134 and 140, plate 142 can move in an XY plane in either or both the X and Y directions relative to table 122.

A conventional chain saw 146 having a motor 147 is carried by plate 142 for movement therewith. Chain saw 146 includes a link cutting chain 148 which extends laterally from the adjacent side edge 150 of table 122 as shown in FIGS. 7 and 8. By moving the chain saw 146 to the right when viewing FIGS. 7 and 8, the chain saw can penetrate and cut into the end face 156 of door 12. The depth of the mortise can be as great as the distance of travel of plate 142 to the right when viewing FIGS. 7 and 8. By moving the plate 142 longitudinally of tracks 134, the mortise can be cut lengthwise of the door. To increase the width of the mortise, handle 132 is rotated to raise or lower the table and thereby the chain saw with reference to surface 126.

In use, door 12 is mounted in a fixed position adjacent to apparatus 120. With chain saw 146 in operation, plate 142 is moved to the right to cause the chain saw to penetrate the door and to cut it to a predetermined depth. Then the plate 142 is moved longitudinally of tracks 134 to cut the mortise to a predetermined height. Then, handle 132 is rotated to cut the door so that the mortise will have a predetermined width.

We claim:

1. A latch assembly for a door having a mortise, an end face and a pair of aligned holes on opposite sides of the mortise, comprising: a pair of spaced support plates; a latch plate spanning the distance between and connecting first end margins of the support plates; a latch bolt shiftably mounted on the latch plate and movable from a first position extending outwardly from the latch plate to a second position substantially retracted within the space between the support plates, said support plates adapted to be inserted into the mortise in the door with the latch plate substantially flush with the end face of the door, said support plates having respective holes therethrough for alignment with the holes of the door when the support plates are in the mortise; a member between the support plates, said member being of a material permitting light to pass therethrough; means mounting the member for rotation relative to the plates about an axis extending through the holes in the plates; a door knob structure coupled to the member to permit manual rotation of the member; a roller rotatably mounted on the outer periphery of the member, said roller being in an equilibrium position when said latch bolt is in said first position and being out of said equilibrium position when the latch bolt is in said second position; means coupled with the latch bolt for shifting the same into the second position thereof when the member is rotated about said axis in either direction; and means coupled with the roller for biasing the roller into said equilibrium position to thereby cause the latch bolt to be biased into said first position when the latch bolt is in said second position.

2. A latch assembly as set forth in claim 1, wherein said member is transparent.

3. A latch assembly as set forth in claim 1, wherein said member is translucent.

4. A latch assembly as set forth in claim 1, wherein said member has a cylindrical outer periphery, said mounting means for the member including a number of spaced bearings carried by one of the support plates and engageable with the outer periphery of the member.

5. A latch assembly as set forth in claim 4, wherein is included a transversely circular band on the outer periphery of the member, each bearing member having an annular groove therein for complementally receiving the band.

6. A latch assembly as set forth in claim 1, wherein is included a rigid tab secured to and extending radially outwardly from the outer periphery of the member, said roller being rotatably mounted on the outer end of the tab.

7. A latch assembly as set forth in claim 1, wherein said shifting means includes a first link pivotally coupled intermediate its ends on said one support plate, a second link coupled at one end thereof to one of the support plates and intermediate its ends to the first link, the opposite end of the second link normally engaging the roller, a third link pivotally coupled at one end thereof to said one support plate and engageable with the roller at a location spaced from the location thereon engaged by the second link, the third link being coupled to the first link, and means biasing the first link in a direction to cause the second and third links to engage the roller.

8. A latch assembly as set forth in claim 7, wherein the first link has a curved slot therein, and a pin carried by said one support plate and extending said slot for movement relative thereto.

9. A latch assembly as set forth in claim 7, wherein said first link is pivotally coupled at one end thereof to said second link and at the opposite end thereof to said third link.

10. A latch assembly as set forth in claim 7, wherein is included a pin rotatably mounting the first link intermediate its ends on said one support plate, there being a fourth link pivotally secured at one end thereof to the latch bolt and coupled to one end of the first link for movement therewith relative to said one support plate, said fourth link being movable linearly in one direction as a function rotation of said member in one rotative sense and said fourth link being movable in said one direction in response to the rotation of the member in the opposite rotative sense.

11. A latch assembly as set forth in claim 8, wherein one end of said second link is pivotally secured by a third pin on the one support plate, the opposite end of the second link being in engagement with the roller.

12. A latch assembly as set forth in claim 10, wherein one end of the third link is pivotally secured to the support plate, there being a fifth link, a pin pivotally interconnecting the fifth link intermediate the ends thereof to the third link, one end of the fifth link being pivotally coupled to the first link, and spring means coupled to the opposite end of the fifth link and to the one support plate, whereby the fifth link biases the first link toward its equilibrium position.

* * * * *